US007596920B2

(12) United States Patent
Konstanczak

(10) Patent No.: US 7,596,920 B2
(45) Date of Patent: Oct. 6, 2009

(54) FLOOR PANEL

(75) Inventor: Marek Konstanczak, Barlinek (PL)

(73) Assignee: Barlinek, S.A., Barlinek (PL)

( * ) Notice: Subject to any disclaimer, the term of this patent is extended or adjusted under 35 U.S.C. 154(b) by 711 days.

(21) Appl. No.: 10/541,114

(22) PCT Filed: Dec. 28, 2003

(86) PCT No.: PCT/PL03/00147

§ 371 (c)(1),
(2), (4) Date: Jun. 30, 2005

(87) PCT Pub. No.: WO2004/059104

PCT Pub. Date: Jul. 15, 2004

(65) Prior Publication Data

US 2006/0174578 A1 Aug. 10, 2006

(30) Foreign Application Priority Data

Dec. 31, 2002 (PL) ..... 358084

(51) Int. Cl.
*E04C 3/00* (2006.01)

(52) U.S. Cl. ..... 52/589.1; 52/578; 52/588.1; 52/592.1

(58) Field of Classification Search ..... 52/390, 52/578, 589.1, 591.1
See application file for complete search history.

(56) References Cited

U.S. PATENT DOCUMENTS 6,006,486 A 12/1999 Moriau et al. ..... 52/589.1
6,216,409 B1 * 4/2001 Roy et al. ..... 52/589.1
6,324,809 B1 * 12/2001 Nelson ..... 52/592.2
6,332,733 B1 * 12/2001 Hamberger et al. ..... 403/329
6,490,836 B1 12/2002 Moriau et al. ..... 52/589.1
6,591,568 B1 * 7/2003 Pålsson ..... 52/592.2
6,601,359 B2 * 8/2003 Olofsson ..... 52/588.1
6,606,834 B2 * 8/2003 Martensson et al. ..... 52/578

(Continued)

FOREIGN PATENT DOCUMENTS

WO WO 01/02671 1/2001

(Continued)

*Primary Examiner*—Richard E. Chilcot, Jr.
*Assistant Examiner*—Patrick Maestri
(74) *Attorney, Agent, or Firm*—Burns & Levinson LLP; Orlando Lopez

(57) ABSTRACT

The floor panel (1) which, at least at two opposite sides, is provided with coupling parts in the form of a tongue (6) at one side and a groove (5) at the opposite side, wherein the coupling parts are provided with mechanical locking elements in the form of a protrusion (7), which is formed at the tongue, and a lip (8) bordering the groove, is distinguishable by that the bearing surface (9) of the lip (8) at the longer arm of the groove (5) is concave on the arc with the first radius ($r_1$) whose point of engagement is situated at the upper edge of the panel (1) whereas the protrusion (7) of the tongue (6) has in its cross-section the form of a circular sector with the third radius ($r_3$) which is shorter than the first radius, wherein the lower part of the lip (8) and the lower part of the panel (1) from the side of the circular protrusion (7) have the second bearing surfaces (9') which are inclined in relation to the vertical plane in one direction, at the first acute angle ($\alpha$).

21 Claims, 5 Drawing Sheets

U.S. PATENT DOCUMENTS

Figure 1:
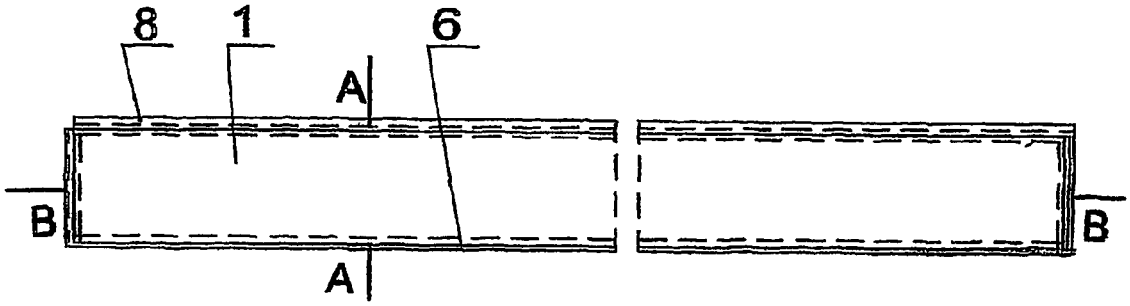

| | | | | |
|---|---|---|---|---|
| 6,766,622 | B1 * | 7/2004 | Thiers | 52/591.3 |
| 6,769,218 | B2 * | 8/2004 | Pervan | 52/591.4 |
| 6,772,568 | B2 * | 8/2004 | Thiers et al. | 52/592.1 |
| 6,786,019 | B2 * | 9/2004 | Thiers | 52/589.1 |
| 6,851,241 | B2 * | 2/2005 | Pervan | 52/592.1 |
| 6,874,292 | B2 * | 4/2005 | Moriau et al. | 52/590.2 |
| 7,055,290 | B2 * | 6/2006 | Thiers | 52/592.2 |
| 2002/0007608 | A1 | 1/2002 | Pervan | 52/578 |
| 2003/0188504 | A1 * | 10/2003 | Ralf | 52/578 |
| 2004/0031225 | A1 * | 2/2004 | Fowler | 52/578 |

FOREIGN PATENT DOCUMENTS

| | | |
|---|---|---|
| WO | WO 01/48332 | 7/2001 |

* cited by examiner

FLOOR PANEL

The subject of the invention is a floor panel.

The floor covering, which is well-known of the Polish description of application P324923, consists of hard floor planks (panels) in the form of a rectangle which, at least at the edges of two opposite sides are provided with coupling parts, cooperating with each other. These parts have substantially the form of a tongue and a groove and are provided with integrated mechanical locking means which prevent the drifting apart of two coupled floor panels in a direction perpendicular to the related edges and parallel to the underside of the coupled floor panels. The locking elements are represented in several forms, the common feature of which is that the tongue, in its lower part, is provided with a recess well-fitting by its form to the form of the recess in the lower arm of the groove, whereas the contact surface, making a bearing surface, is inclined to the centre and downwards. According to the first form, the bottom surface of the tongue is convex on the radius whose point of engagement is situated at the upper edge of the floor panel, and on the same radius it is provided a formed recess in the lower arm of the groove. The upper surface of the tongue and the upper wall of the groove are flat and horizontal. The tongue is seated in the groove in such a manner that there is a space between its front surface and the bottom of the groove, where possible rest dust can be pushed by the tongue. Equirounded surfaces of the locking elements make the assembling easier and, at the same time, eliminate a play in a direction parallel to the underside. At the other form of the locking elements, the upper and the lower surface of the tongue and the groove surfaces corresponding with them are formed on the arcs, the radii of which are engaged at the upper edge of the panel, wherein, advantageously, the difference between the radius of the lower surface and that of the upper surface is equal to 2 mm.

At the next form of locking elements, the lower longer arm of the groove is an elastically bendable part which, in the engaged condition, is partially bent, whereby a produced tension force exerts the pressure upon the coupled panels. The lower arm has, near its external edge, a recess, the cross-section of which has the form of a triangle put on its rounded vertex, so that its surface situated nearer the edge, being the surface of contact with the protrusion of the tongue, is inclined towards the centre and downwards at an angle of 30 to 70 degrees. The upper surface of the groove is flat and horizontal. The tongue has in its front part the form of a trapezoidal wedge, and closer to the core it has in its lower part a protrusion similar in shape to a triangle having a rounded vertex, well-fitting to the form of the recess in the lower arm of the groove. After the floor panels have been coupled, the locking parts prevent the drifting apart of the panels and secure for precise, free of gaps, floor covering.

From the Polish description of application P 349278 it is well-known a floor panel having at the one side a key formed by two rigid arms. One of the two rigid arms is longer than the other. The longer rigid arm has a recess in the form of a trapezoid, which forms an element of the locking joint. At the opposite side, the panel has a tongue provided with a trapezoidal protrusion which is situated at its lower part and which enters the trapezoidal recess in the longer arm of the groove of the adjacent panel, and their contact surface, being bearing surface, is inclined to the centre and downwards.

At any changes of humidity of the surrounding air, especially in case of panels made of hydroscopic material, as for example of wood or wood derivative material, the solutions of this type are less useful because of relatively large material shrinkage and expansion caused by the changes of humidity in the surrounding, which can result in the warping of the floor. The grade of expansion or shrinkage depends on the basic anatomic directions of wood structure and on its sort, which is of essential importance when the properties of floor panels made of the layers of various wood sorts and variable orientation of fibre pattern. The coefficients of shrinkage or the increases in dimensions are different according to the sort of wood, i.e. of pine, oak or beech, at the same value of the change of humidity.

The panel according to the invention is provided with coupling parts in the form of a tongue at the one side and the groove at the opposite side, wherein the coupling parts are provided with mechanical locking elements in the form of a protrusion at the tongue and a lip at the longer arm of the groove, which is characterized in that the bearing surface of the lip is concave along the arc with the first radius whose point of engagement is situated at the upper edge of the panel, whereas the recess of the tongue has in its cross-section the form of a circular sector with the third radius which is shorter than the first radius, wherein the lower part of the lip and the lower part of the panel from the side of the circular protrusion have the second bearing surfaces inclined to the vertical plane in one direction, at the first acute angle, advantageously equal to about 30°. Advantageously, the ratio of the third radius to the first radius is equal to 1:3 approximately. Advantageously, the internal surface of the recess in the longer arm of the groove, which is situated close to the lip, is concave on the arc with the second radius which is longer than the first radius. Advantageously, the ratio of the first radius to the second radius is equal to 1:1.5 approximately. Advantageously, the panel is provided with at least one longitudinal groove situated from the bottom of the panel. The mentioned groove compensates stresses arising near the coupling and creates a ventilation space of the underside. At the one form of the panel, the bearing surface of the lip, near the upper edge of the lip, turns into the flat surface inclined in relation to the vertical plane at the second acute angle equal to, advantageously, 15°, forming a nose which prevent the sliding out of the circular protrusion of the tongue from the recess in the longer arm of the groove. At the other form of the panel, the second internal surface of the recess in the lower arm of the groove is flat and inclined in relation to the horizontal plane at the third acute angle equal to, advantageously, 20°. Near the groove, the second internal surface turns into an offset, the surface of which is flat, inclined in relation to the vertical plane at the fourth acute angle equal to, advantageously, about 38°. At the next form, the panel, on its bearing surface, is provided with a longitudinal recess formed like a trough, in cross-section, the surface of which is concave on the arc with the third radius equal to the radius of the circular protrusion of the tongue. Advantageously, the second internal surface is flat and inclined in relation to the horizontal plane at the third acute angle equal to, advantageously, 20° and near the groove turns into an offset, the surface of which is flat, inclined in relation to the vertical plane at the fourth acute angle equal to, advantageously, about 38°. Advantageously, the floor panel is made of wood or wood derivative layerwise glued material. Advantageously, the floor panel, of all above mentioned forms, is provided, at its short sides, with the groove having the near-rectangular form, in cross-section, on the lower arm of which it has a triangular recess, at one side, whereas at the opposite side the panel has the second tongue of the near-rectangular form which is provided with the protrusion formed like a triangle at its lower part.

The solution according to the invention permits to couple and uncouple easy the floor panels and to keep high rigidity of the floor, and also it ensures that the panels can displace freely when any changes of wood humidity occur, whereby the possibility of the warping of the floor or the destruction of the couplings is eliminated. The forced displacing of the panels, as assembled to a floor plate, each other due to the changes of wood humidity, when the microclimate in a room changes, is stabilized by the pressure of the circular protrusion upon the bearing surface of the lip at the longer arm of the groove. The lip transmits the load onto the second bearing surfaces at the lower part of the panel, causing controlled movement of the circular protrusion and thereby a light drafting apart of the panels in a direction parallel to the underside. With the decrease of wood humidity the panels revert to the initial position without negative consequences in the form of the loss of rigidity of the floor. The solution according to the invention ensures good ventilation of the underside space, whereby an inconvenient influence of the moisture included in the air on the working parameters of the floor is limited to a certain grade.

Figure 2:
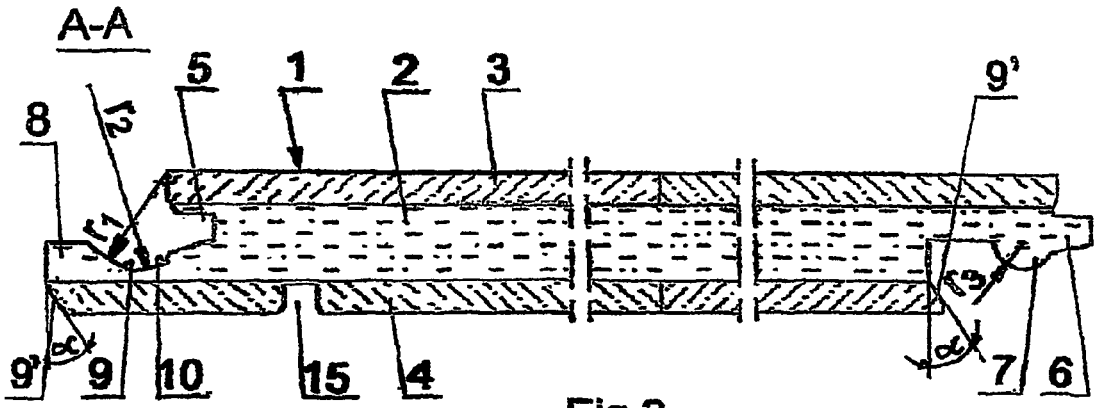
Figure 3:
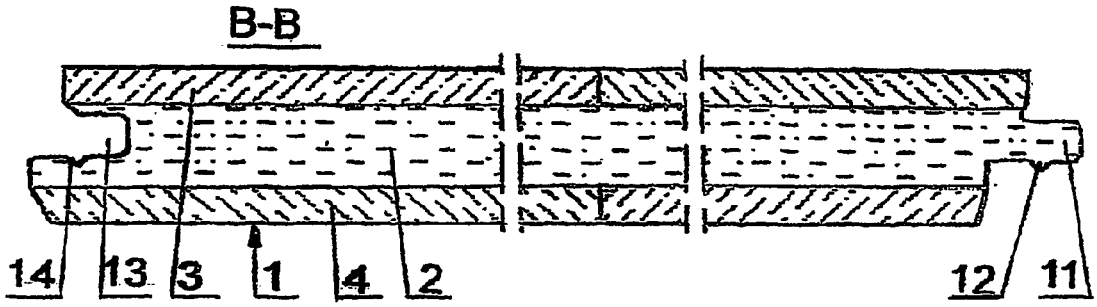
Figure 4:
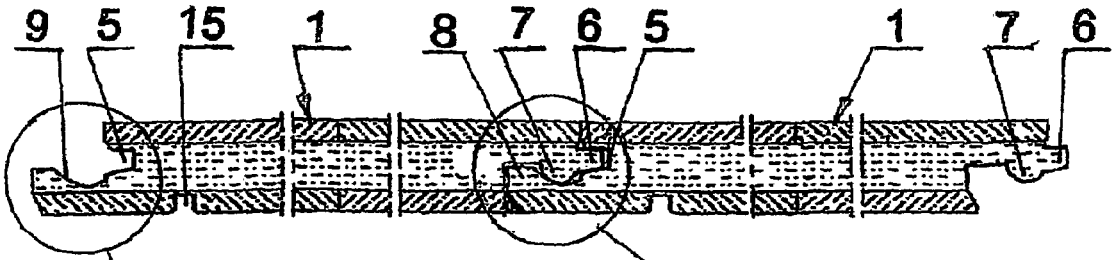
Figure 5:
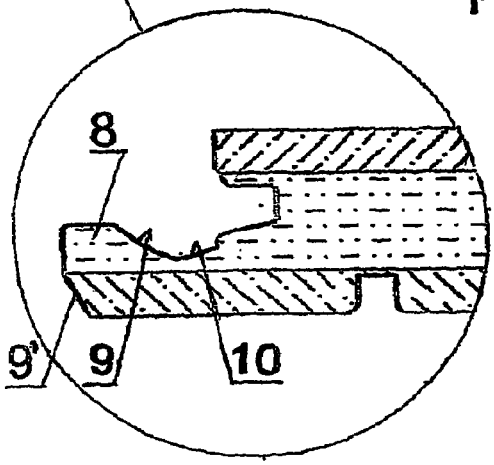
Figure 6:
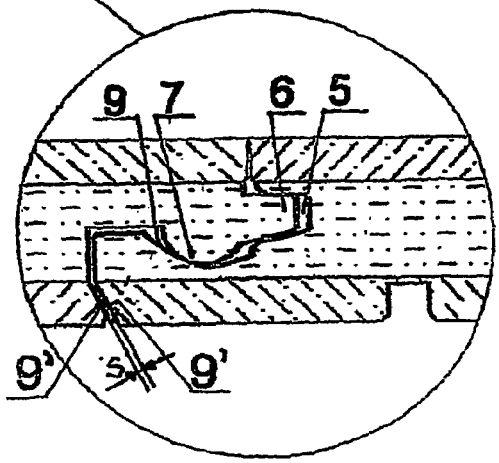
Figure 7:
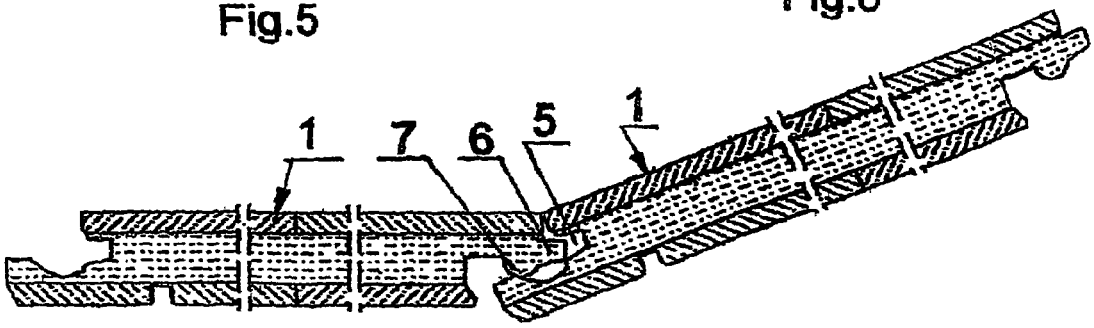
Figure 8:
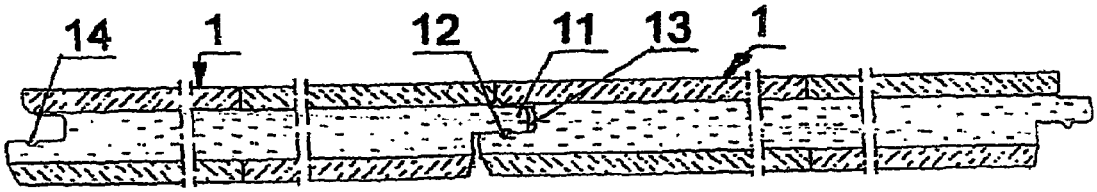
Figure 9:
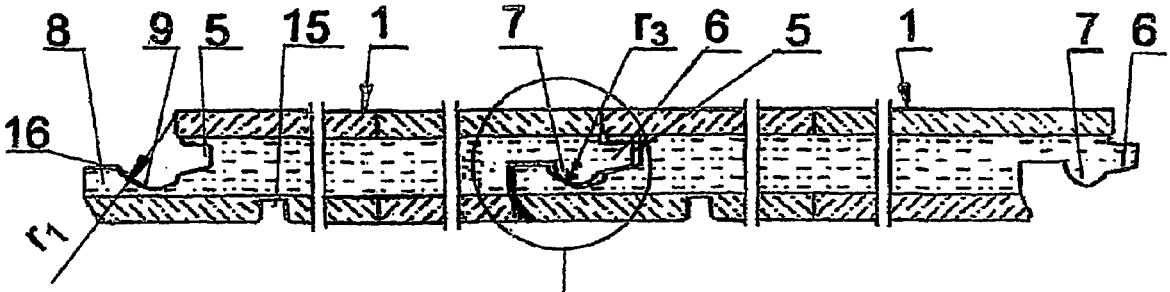
Figure 10:
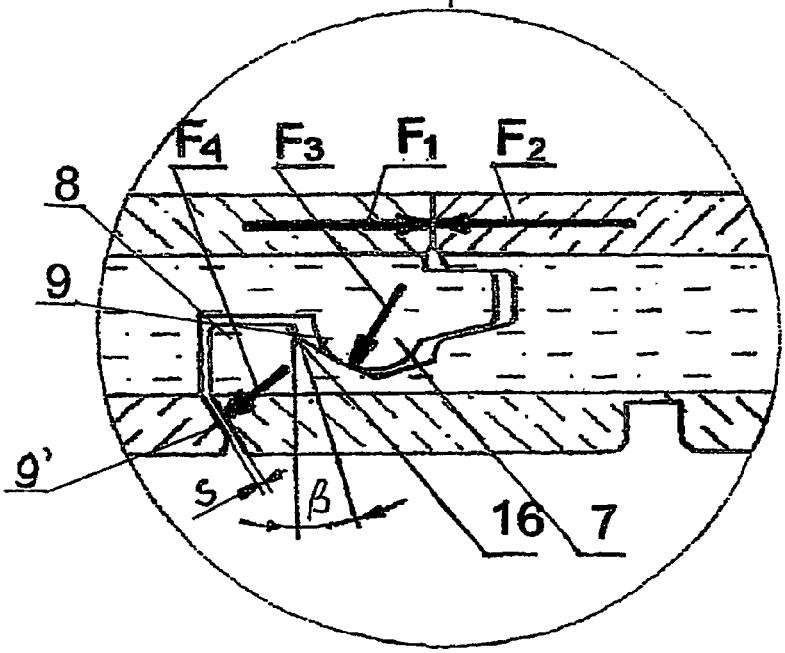
Figure 11:
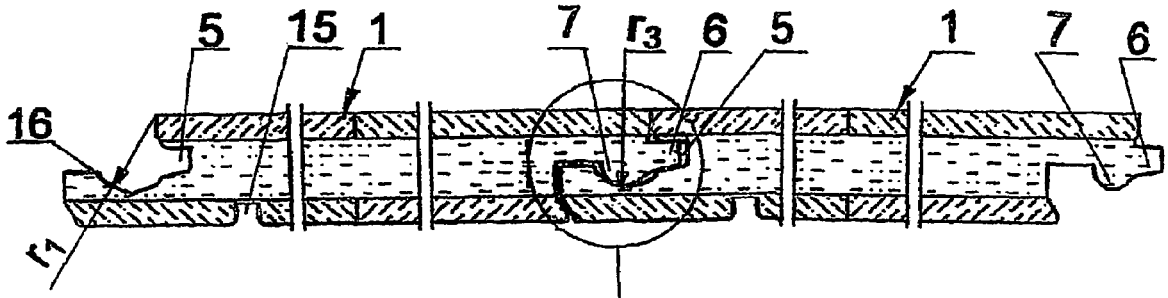
Figure 12:
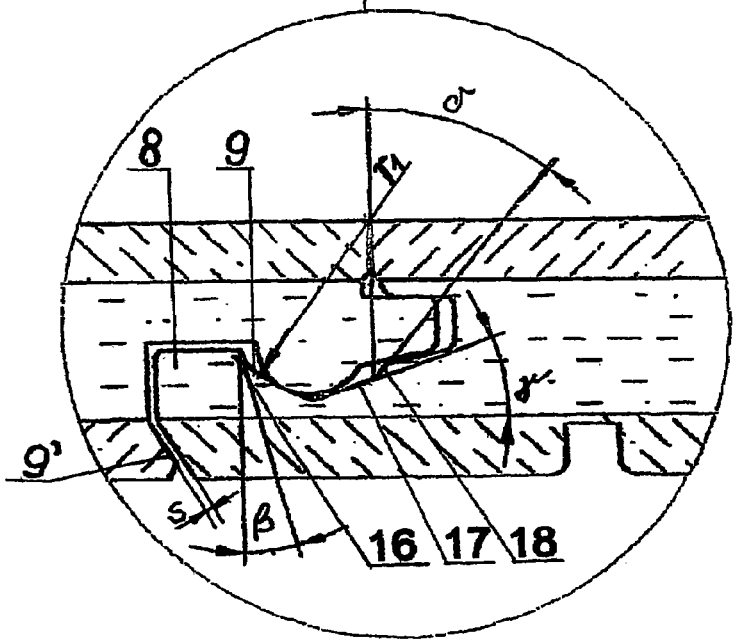
Figure 13:
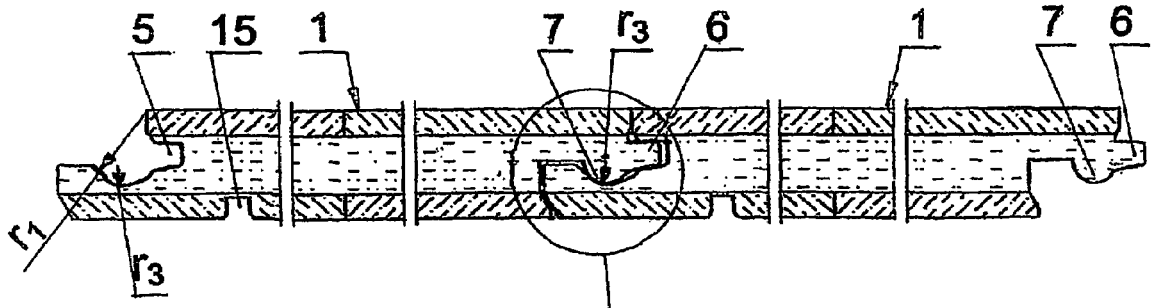
Figure 14:
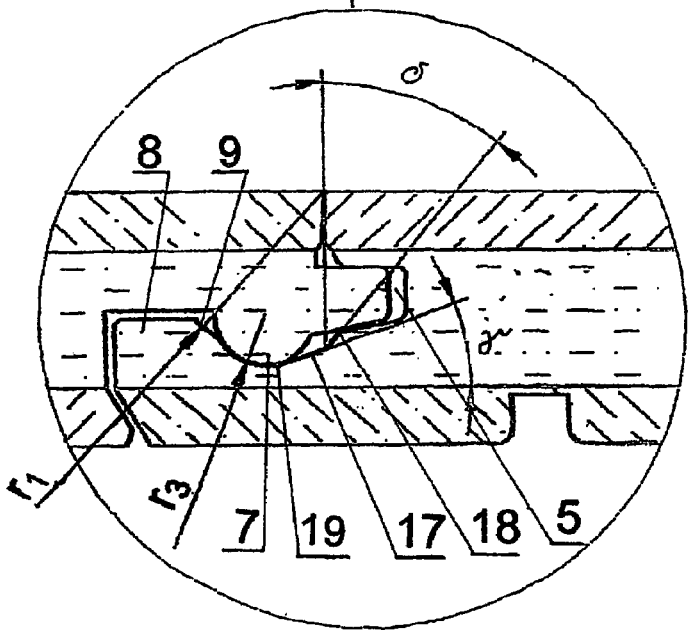

The solution according to the invention is explained better in the examples of realization and in the drawings where FIG. 1 shows the panel in top view, FIG. 2 shows the panel in its cross-section, in the plane A-A from FIG. 1, FIG. 3 shows the panel in its longitudinal section B-B from FIG. 1, FIG. 4 shows two panels coupled by means of the coupling parts, as viewed from the front side, FIG. 5 shows an enlarged fragment of the panel provided with the groove, FIG. 6 shows the coupling of two panels in enlargement, FIG. 7 shows two panels being coupled, FIG. 8 shows two coupled panels as viewed from the longitudinal side, FIG. 9 shows a constructional form of the panels in the coupled condition, FIG. 10 shows an enlarged detail of the coupling of the panels shown in FIG. 9, FIG. 11 shows a different constructional form of the coupled panels, FIG. 12 shows an enlarged detail of the coupling of the panels shown in FIG. 11, FIG. 13 shows the next constructional form of the coupled panels, FIG. 14 shows an enlarged detail of the coupling of the panels shown in FIG. 13.

EXAMPLE 1

The floor panel 1 has the shape of a rectangular plate made of wood or of wood derivative layerwise glued material, consisting of the core 2, face layer 3 and bottom layer 4. At the opposite, lateral longitudinal walls of the panel 1 it is situated at the one side a formed groove 5 having, in cross-section, the form of an unsymmetrical trapezoid, whereas on the opposite wall a tongue 6 in the shape of an unsymmetrical trapezoid which has a circular protrusion 7 on its lower part. The formed groove is limited from the bottom by the longer arm-protruded outside the edge of the panel and ended with the lip 8. The lip 8 is formed by the extraction of the material from the longer arm of the groove, wherein this arm makes an element of the locking connection which has, in cross-section, the near-triangular form, the two lateral surfaces of which intersect near the bottom layer 4 of the panel at an obtuse angle. The lateral surface of the recess, situated on the lip 8, is the bearing surface 9. When the panels are assembled, it contacts to the circular protrusion 7 of the tongue 6 of the other panel and limits the movement of it in a direction parallel to the underside. The bearing surface 9 is inclined to the centre and downwards, is concave and has a curvature with the radius $r_1$ whose point of engagement is situated at the upper edge of the panel. The other lateral surface of the recess, the internal surface 10, situated between the groove 5 and the lip 8, goes up and at the upper part is united with the surface of the groove 5. The internal surface 10 is concave and has a curvature with the second radius $r_2$ which is longer than the first radius $r_1$. The ratio of the first radius to the second radius $r_1:r_2$ is equal to 1:1.5 approximately. The circular protrusion 7 of the tongue 6 has the form of a circular sector having the radius $r_3$, wherein the ratio of the third radius $r_3$ to the first radius is equal to 1:3 approximately. The recess in the longer arm of the groove 5 with the lip 8 and the circular protrusion 7 of the tongue 6 of the adjacent panel are locking elements of the coupling, preventing the displacing of the panel in a direction parallel to the underside. Behind the circular recess 7 of the tongue 6, nearer the centre of the panel, it is situated a recess, the width of which is a little larger than the width of the lip 8, and the lip 8 of the adjacent panel enters the mentioned recess. The lower front surfaces of the panel 1, from the side of the mentioned recess and from the side of the lip 8, are inclined in relation to the vertical plane in one direction, at the first acute angle $\alpha$ equal to about 30°. The mentioned surfaces are the second bearing surfaces 9' which transfer pressure forces caused by the expansion of the panel material when it is moistened. The dimensions of the panel are matched, so that, after assembling the panels, in the dry condition, the gap s between the second bearing surfaces 9' corresponds to the assumed increase of the linear dimensions of the panels. The mentioned gap is about 0,2 mm wide. At the short, transverse sides of the panel 1 there are coupling parts, at the one side it is the second tongue 11 with a triangular protrusion 12, whereas at the opposite side it is the second groove 13, in the longer arm of which it is situated the second recess 14 formed like an isosceles triangle with the acute vertex. The tongue 11 has, in cross-section, the form of a rectangle with rounded quoins, and the groove 13 has the same form. The panel 1 has in its bottom layer 4 one or several longitudinal grooves 15. The groove 15 secures against excessive stresses which can be caused by tensile forces occurring near the coupling, oriented transversely to the direction of fibre pattern in the middle layer of the panel, which could cause that the panel would crack and laminate. The mentioned groove also makes it possible to ventilate the space under the floor and to take out fast the humidity given up by the wood from this space. The moist air is lighter than the dry air and so the circulation of the air in the space under the floor is forced intrinsically.

Due to the changes of humidity of the surrounding air, the hydroscopic material of the panel expands or shrinks. During the increase of wood humidity the elements of the bottom and middle layer of the panel become moistened at first. Consequently, the circular protrusion 7 begins to exert pressure upon the bearing surface 9 of the lip 8 with the third pressure force F3. The lip 8 is pressed against the second bearing surface 9' with the fourth force F4, and, consequently, the gap s will be closed. The resistance exerted by the second bearing surfaces 9' causes that the circular element 7 shifts on the bearing surface 9 resulting in the little drifting apart of the panels. Then it follows the increase of wood humidity in the face layer and the increase of its dimensions in a direction transverse to the longitudinal axis of the panel. It comes into being the force cause by the expansion of wood, the first force F1 and the second force F2, increasing the pressure exerted by the circular protrusion 7 upon the bearing surface 9. With the decrease of wood humidity the panels revert to the initial position without negative consequences in the form of the loss of rigidity of the floor.

EXAMPLE II

A solution analogical to the example I, wherein the bearing surface 9 of the lip 8 near the upper edge turns into the flat surface inclined in relation to the vertical plane at the second acute angle β which is equal to about 15°, forming the nose 16 locking additionally the coupling, preventing the sliding out of the circular protrusion 7 from the recess in the longer arm of the groove.

EXAMPLE III

A solution analogical to the example II, wherein the second internal surface 17 of the recess in the lower arm of the groove 5 is flat and inclined in relation to the horizontal plane at the third acute angle γ which is equal to about 20°. The internal surface 17 near the groove 5 turns into the flat surface which is flat and inclined in relation to the vertical plane at the fourth acute angle δ which is equal to about 38°. This solution makes mechanical working of the panel easier.

EXAMPLE IV

A solution analogical to the example I, wherein on the bearing surface 9 there is a recess shaped like a trough 19, the surface of which is concave along the arc with the third radius $r_3$ equal to the radius of the circular protrusion 7. The second internal surface 17 of the recess in the lower arm of the groove 5 is flat and inclined in relation to the horizontal plane at the third acute angle γ which is equal to about 20°. The internal surface 17, near the groove 5, turns into the offset 18, the surface of which is flat and inclined in relation to the vertical plane at the fourth acute angle δ which is equal to about 38°. When the panels are assembled, the circular protrusion 7 abuts against the trough 19, increasing the rigidity of the coupling.

The invention claimed is:

1. A floor panel comprising a rectangular plate which, at least at two opposite sides, is provided with coupling parts in the form of a tongue at the one side and a groove at the opposite side, the coupling parts comprising integrated mechanical locking means in the form of a protrusion shaped on the tongue and a tip bordering the groove which is formed by the extraction of the material along a longer arm of the groove, a bearing surface (9) of the lip being inclined to a center of the floor panel and downwards, the bearing surface (9) of the lip (8) at the longer arm of the groove (5) being concave on an arc with a first radius (r1), the first radius having a point of engagement which is situated at an upper border of the floor panel (1), the protrusion (7) of the tongue (6) having, in cross-section, the form of a circular section with a third radius (r3) which is shorter than the first radius, and a lower part of the lip (8) and at a lower part of the floor panel (1) from a side of the circular protrusion (7) having second bearing surfaces (9') inclined in relation to a vertical plane into one direction, at a first acute angle (α); each of said second bearing surfaces (9') being substantially parallel to each other;

an internal surface (10) of a recess along the longer arm of the groove, situated close to the lip (8), is concave on an arc with a second radius (r2), which is longer than the first radius (r1);

the bearing surface, the first radius, the third radius and the first acute angle being selected to ensure that, when one floor panel is coupled to another floor panel, said one floor panel and said another floor panel can displace freely when changes in humidity occur;

whereby possibility of warping of a floor or the destruction of the couplings is substantially eliminated.

2. The floor panel according to claim 1, wherein the ratio of the third radius ($r_3$) to the first radius ($r_1$) is substantially equal to 1:3; and wherein a ratio of the first radius ($r_1$) to the second radius ($r_2$) is substantially equal to 1:1.5.

3. The floor panel according to claim 1, wherein the first acute angle (α) is substantially equal to 30°.

4. The floor panel according to claim 1, comprising at least one longitudinal groove (15) which is situated from a bottom of the panel.

5. The floor panel according to claim 1, wherein a bearing surface (9) of the lip (8), near an upper edge of the lip, turns into a flat surface, which is inclined in relation to the vertical plane at a second acute angle (β), forming a nose (16).

6. The floor panel according to claim 5, wherein the second acute angle (β) is substantially equal to 15°.

7. The floor panel according to claim 5, wherein a second internal surface (17) of a recess in a lower arm of the groove (5) is flat and inclined in relation to a horizontal plane at a third acute angle (γ), wherein the second internal surface (17), near the groove (5), turns into an offset (18) whose surface is flat, inclined in relation to a vertical plane at a fourth acute angle (δ).

8. The floor panel according to claim 7, wherein the third acute angle (γ) is substantially equal to 20° and the fourth acute angle (δ) is substantially equal to 38°.

9. The floor panel according to claim 1, wherein the bearing surface (9) comprises a longitudinal recess shaped like a trough (19), in cross-section, the surface of which is concave on an arc of the third radius ($r_3$) which is equal to a radius of the circular protrusion (7).

10. The floor panel according to claim 9, wherein the second internal surface (17) is flat and inclined in relation to the horizontal plane at the third acute angle (γ), wherein the second internal surface, near the groove (5), turns into an offset (18) of flat surface inclined in relation to the vertical plane at the fourth acute angle (δ).

11. The floor panel according to claim 10, wherein the third acute angle (γ) is substantially equal to 20° and the fourth acute angle (δ) is substantially equal to 38°.

12. The floor panel according to claim 1, wherein said floor panel is composed of wood or wood derivative layerwise glued material.

13. The floor panel according to claim 1, wherein short sides at one edge comprise a groove in a near-rectangular form, in cross-section, wherein the lower arm of the groove comprises a triangular recess (14) whereas at an opposite side it comprises a second tongue (11) in near-rectangular form, which comprises a second protrusion (12) shaped like a triangle in its lower part.

14. The floor panel according to claim 7, wherein the bearing surface (9) comprises a longitudinal recess shaped like a trough (19), in cross-section, the surface of which is concave on the arc of the third radius ($r_3$) which is equal to the radius of the circular protrusion (7).

15. The floor panel according to claim 14, wherein the second internal surface (17) is flat and inclined in relation to the horizontal plane at the third acute angle (γ), wherein the second internal surface, near the groove (5), turns into an offset (18) of flat surface inclined in relation to the vertical plane at the fourth acute angle (δ).

16. The floor panel according to claim 15, wherein the third acute angle (γ) is substantially equal to 20° and the fourth acute angle (δ) is substantially equal to 38°.

17. The floor panel according to claim 7, wherein short sides at one edge comprise a groove in the near-rectangular form, in cross-section, wherein the lower arm of the groove comprises a triangular recess (14) whereas at the opposite side it comprises a second tongue (11) in near-rectangular form, which comprises a second protrusion (12) shaped like a triangle in its lower part.

18. The floor panel according to claim 9, wherein short sides at one edge comprise a groove in the near-rectangular form, in cross-section, wherein a lower arm of the groove comprises a triangular recess (14) whereas at an opposite side it comprises a second tongue (11) in near-rectangular form, which comprises a second protrusion (12) shaped like a triangle in its lower part.

19. The floor panel according to claim 14, wherein short sides at one edge comprise a groove in the near-rectangular form, in cross-section, wherein a lower arm of the groove comprises a triangular recess (14) whereas at an opposite side it comprises a second tongue (11) in new-rectangular form, which comprises a second protrusion (12) shaped like a triangle in its lower part.

20. A floor panel in a shape of a rectangular plate provided with a tongue (6) at one side and a groove (5) at an opposite side, the tongue (6) and the groove (5) forming coupling parts at least at two opposite sides with neighboring floor panels, the coupling parts comprising integrated mechanical locking means having a protrusion (7) formed on the tongue (6) and a lip (8) bordering the groove (5) formed by an extraction of material along a longer arm of the groove (5), wherein the lip (8) has a bearing surface (9) inclined to a center of the floor panel and downwards, the bearing surface (9) of the lip (8) being concave on an arc with a first radius ($r_1$), the first radius having a point of engagement situated at an upper border of the floor panel (1), and wherein the protrusion (7) of the tongue (6) has, in cross-section, a circular section with a third radius ($r_3$) being shorter than the first radius ($r_1$), and wherein a lower part of the lip (8) and a lower part of the floor panel (1) facing a side of the circular protrusion (7) have second bearing surfaces (9') inclined in relation to a vertical plane at the same direction at a first acute angle (α);each of said second bearing surfaces (9') being substantially parallel to each other; the second bearing surfaces (9') of the neighboring floor panels after assembling floor panels are distanced at a gap (s) in dried condition and transfer pressure forces caused by expansion of panel material when moistened.

21. A floor panel having a shape of a rectangular plate provided with coupling parts in a form of a tongue (6) at one side and a groove (5) at an opposite side, the coupling parts comprising integrated mechanical locking means having a protrusion (7) formed on the tongue (6) and a lip (8) bordering the groove (5) formed by extraction of material along a longer arm of the groove (5), wherein the lip (8) has a bearing surface (9) inclined to a center of the floor panel and downwards, the bearing surface (9) of the lip (8) being concave with a curvature with a first radius ($r_1$), the first radius having a point of engagement situated at an upper edge of the floor panel (1), and wherein the protrusion (7) of the tongue (6) has in a cross-section a circular section with a third radius (r3) being shorter than the first radius ($r_1$), and wherein a lower part of the lip (8) and a lower part of the floor panel (1) facing a side of the circular protrusion (7) have second bearing surfaces (9') inclined in relation to a vertical plane at one direction at a first acute angle (α); each of said second bearing surfaces (9') being substantially parallel to each other; the second bearing surfaces (9') of the neighboring floor panels after assembling floor panels are distanced at a gap (s) in dried condition and transfer pressure forces caused by expansion of panel material when moistened whereby possibility of warping of a floor or destruction of couplings is substantially avoided.

* * * * *